United States Patent [19]

Murnane

[11] 4,017,908

[45] Apr. 19, 1977

[54] RESCUE GARMENT

[76] Inventor: Edward L. Murnane, 3327 La Mesa Drive No. 3, San Carlos, Calif. 94070

[22] Filed: Nov. 3, 1975

[21] Appl. No.: 628,351

[52] U.S. Cl. ..... 2/84; 9/332

[51] Int. Cl.[2] ..... A41D 9/00

[58] Field of Search ..... 2/84, 87, DIG. 4, DIG. 5, 2/DIG. 8, 92, 2.1, 202, 205; 350/98; 9/332, 331, 330, 333, 341, 339, 346

[56] References Cited

UNITED STATES PATENTS

| | | | |
|---|---|---|---|
| 1,097,530 | 5/1914 | Cabelinski | 2/84 |
| 2,160,682 | 5/1939 | Silber | 2/84 |
| 3,837,007 | 9/1974 | Girest | 2/93 |

*Primary Examiner*—Werner H. Schroeder
*Assistant Examiner*—Doris L. Troutman
*Attorney, Agent, or Firm*—Willard M. Graham

[57] ABSTRACT

A sea/land survival, sport, or work garment and self-contained, stowable combination radar-reflective/high visibility hood and large area scarf interconnected for quick deployment by the visor of the hood.

4 Claims, 8 Drawing Figures

RESCUE GARMENT

BACKGROUND OF THE INVENTION

Speedy detection of survivors in rescue operations on land, or at sea, depends in large measure upon the visibility of the survivors. Similarly bicyclists, fisherman, sportsman, oil rig workers, highway workmen etc. require immediate recognition at considerable distances. This is particularly true when weather conditions are less than ideal, and more so where climate conditions are hostile to human life. In the Arctic and Antarctica, for example, the duration of human life in water for example, is measured in minutes. On land, it can be measured in hours depending upon the physical condition of the survivor.

Survival garments, i.e., life jackets, "Mae Wests," and life preservers in current use generally are brightly colored for good visibility. However, even in mild seas, in the case of a sea rescue, most of the garment is submerged in the water, and therefore does not provide much area of color above the waterline, for detection purposes, by visual, radar, and electronic search.

This being so, it is a primary object of my invention to provide a garment, for sea or land rescue, sport, and work, containing a maximum amount of radar-reflective/high visibility detection surface area, which can be stowed within the garment with minimum encumbrance, and quickly extracted and deployed therefrom with minimum effort, thereby converting that life support system or jacket into the best possible detection device.

BRIEF SUMMARY OF THE INVENTION

A survival garment carries a hood with integral sun visor, stowed in a convenient pocket-like recess at the top of the vest portion extending around the rear edge of the neckline thereof. Near the base of the hood, a relatively large area scarf is attached and folded relative to the hood in such a manner as to be extracted and deployed from the recess along with the hood. The sun visor, integral with the hood extends from the recess to define a collar, the collar being maintained in place around the neckline of the garment by Velcro strips, ties, or snaps etc.

The invention will be more readily understood with reference to the detailed description of the invention and appended drawings.

DETAILED DESCRIPTION OF THE INVENTION

Figure 1:
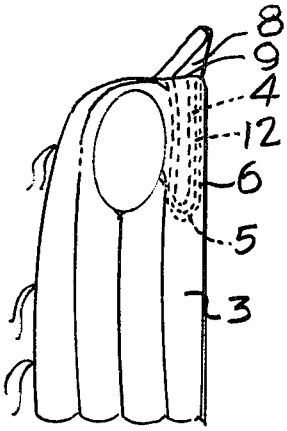
FIG. 1 is a side view of a vest-type life preserver incorporating my present invention in stowed condition.
Figure 2:
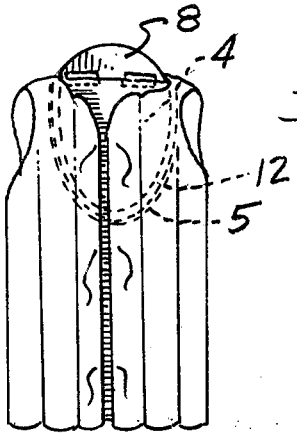
FIG. 2 is a front elevational view of the preserver shown in FIG. 1.
Figure 3:
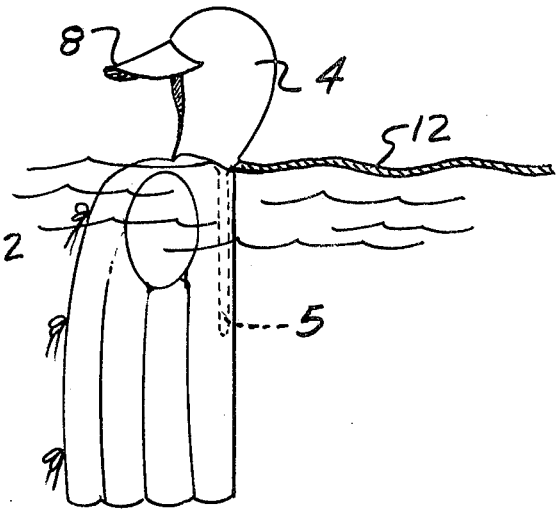
FIG. 3 is a side view showing the preserver of FIGS. 1 and 2 with my invention deployed.

As shown in FIGS. 1–3, a survival garment, such as a vesttype life preserver 3, is provided with a high visibility radar reflective fabric hood 4 stowed in a pocket or recess 5 defined between the lining and back panel 6 thereof. A sun visor 8 integral with the hood 4 normally extends above the neckline 9 of the garment defining a collar-like tab by which the hood can be quickly extracted when needed.

The hood 4 preferably is fabricated of a single ply or multilayer radar reflective superinsulation material such as txg rip stop metalized material obtainable from King Seeley Thermos Company, 37 East St., Winchester, Mass., or any other equivalent radar-reflective/high visibility material which is available in gold, or various fluorescent colors for visual as well as electronic detection.

Sewn, heat-sealed, or otherwise attached to the base of the hood 4. I provide a relatively large scarf 12 fabricated of the same material as the hood. The scarf can be any shape, i.e., square, rectangular, or triangular; the square shape being preferably as it provides the maximum amount of area.

The scarf 12 is rolled or folded and stowed with the hood 4 so that it can be extracted and deployed along with the hood. At each corner of the scarf 12 draw strings or ties 13 can be provided, extending out of the recess if desired, to assist in pulling the scarf from the garment recess if necessary.

When the survivor is in water, the scarf is permitted to trail on the surface to provide a large reflective, highly visible area of color and reflector for radar purposes of ready detection. The underside of the scarf is preferably dark so as not to attract predatory fish such as sharks, for example.

On land, the scarf can be used to cover the back, being tied around the waist using the draw strings or ties. Also, to attract the attention of searchers, the corners of the scarf can be grasped and erected vertically and waved.

If desired, one or more pieces of bouyant material (not shown) such as plastic foam, cork, or the like can be sewn in the hem of the scarf or otherwise attached thereto.

Figure 4:
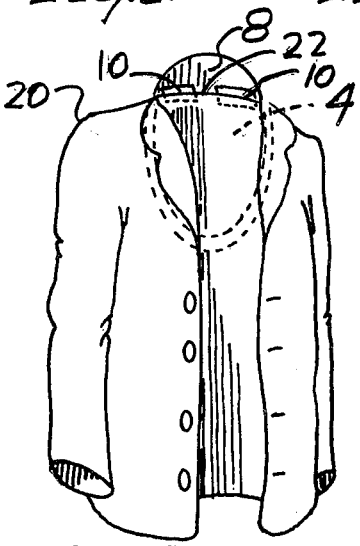
FIG. 4 is a front view of a conventional jacket or coat incorporating my present invention in stowed condition.
Figure 5:
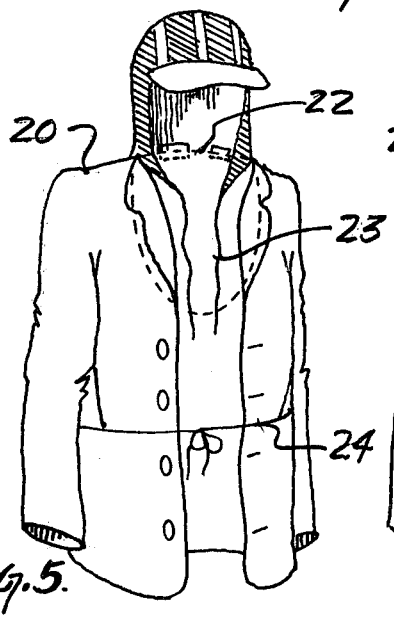
FIG. 5 is a front view of the coat shown in FIG. 4 with my invention deployed.
Figure 6:
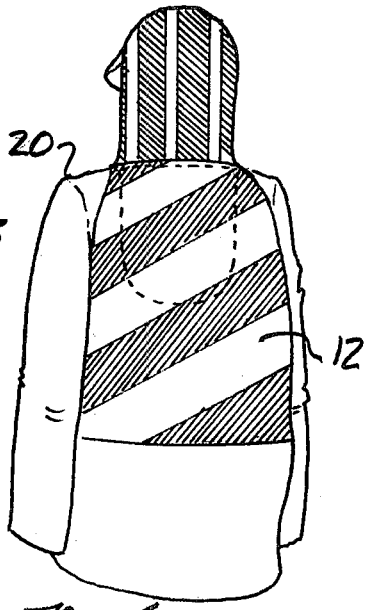
FIG. 6 is a rear view of the coat shown in FIGS. 4 and 5 showing a preferred radar-reflective/high visibility treatment of the material.
Figure 7:
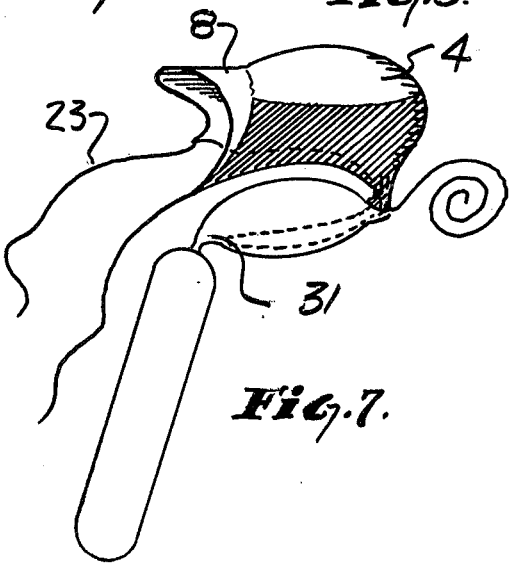
FIG. 7 is a side view of an inflatable life jacket showing my invention in deployed condition.
Figure 8:
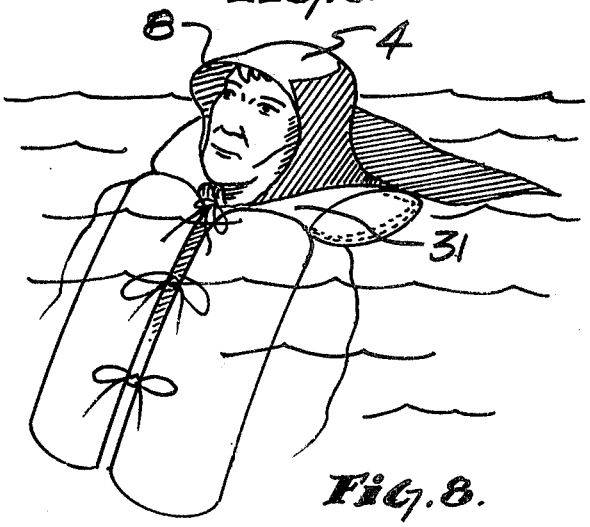
FIG. 8 is a perspective view showing the inflatable life jacket of FIG. 7 in use.

As shown in FIGS. 4–6, a conventional coat or hunter's, fisherman's or workman's jacket 20 is modified for survival purposes by installing the hood 4 and, if desired, a scarf 12 as illustrated in FIGS. 1–3, the visor 8 extending around the neckline 22 and can be maintained in place with the Velcro strips 10, snaps, ties etc, if desired in the same manner as in the life vest. Here, as in FIGS. 1–3, the hood 4 is provided with ties 23, the scarf 12 likewise being provided with draw strings or ties 24 at each free corner to tie the scarf around the waist substantially as shown. FIGS. 7 and 8, show the hood 4 with visor 8, and scarf 12 as used in combination with a reversible inflatable life jacket, the hood 12 and scarf being deployable from a recess 5 in the floatable neck piece 31 in substantially the same manner as in the garments of FIGS. 1–6.

The radar-reflective/high visibility material used in fabricating the hood and scarf can be applied in an infinite variety of combinations, as well as in solid areas, as shown in FIGS. 4–8, for example. The hood and scarf can be emblazoned with additional fluorescent patches, stripes, solid areas, or applied in large letters, symbols, or signs (not shown) such as "S.O.S.," dots and dashes, a red or International Orange colored X or cross (+), according to the imagination of the designer; i.e., essentially any attention attracting means available.

Moreover, while I show the hood and scarf in FIGS. 1–8 as combined with conventional garments, other types of garments such as wet-suits, ponchos, life support devices, individual life rafts and tent structures, etc., can be constructed or retro-fitted with the invention; all being deemed to fall within the spirit and scope of my invention.

I claim:

1. In combination with a rescue/survival garment having at least a neck portion:

a. means defining a stowage pocket in said garment, said pocket having an opening around said neck portion, b. head covering means stowed in said stowage pocket, c. a visor on said head covering means, at least a portion of said visor extending out of said stowage pocket when said head covering means is stowed therein to define a collar-like tab constituting a collar of said garment and by which said head covering means is extractable from said stowage pocket for use, and d. radar-reflective/high visibility means associated with said head covering means.

2. The garment according to claim 1 wherein said head covering means is a cap-like hood.

3. The garment according to claim 1 wherein said radar-reflective/high visibility means associated with said head covering means is one or more strips of radar-reflective/high visibility tape extending over the external surface thereof.

4. The rescue/survival garment according to claim 1 wherein said radar-reflective/high visibility means associated with said head covering means includes a scarf fabricated of radar-reflective/high visibility material joined with said head covering means, and extractable therewith, to trail behind said garment when said head covering means is in use.

* * * * *